United States Patent [19]

Mathis

[11] 3,953,103

[45] Apr. 27, 1976

[54] PLUG-IN TERMINAL

[75] Inventor: Joseph D. Mathis, Indianapolis, Ind.

[73] Assignee: Western Electric Company, Inc., New York, N.Y.

[22] Filed: Jan. 27, 1974

[21] Appl. No.: 544,528

[52] U.S. Cl. ..... 339/276 T; 174/68.5

[51] Int. Cl.[2] ..... H01R 11/08

[58] Field of Search ..... 339/17, 223, 252, 275, 339/276, 217; 174/84 C, 68.5

[56] References Cited

UNITED STATES PATENTS

| | | | |
|---|---|---|---|
| 2,759,163 | 8/1956 | Ustin et al. | 339/223 R |
| 2,852,755 | 9/1958 | Martines | 339/275 T |
| 3,032,602 | 5/1962 | Farnell | 174/84 C |
| 3,032,741 | 5/1962 | Fitzgerald | 339/223 R |
| 3,072,880 | 1/1963 | Olsson | 339/217 S |
| 3,193,795 | 7/1965 | Krehbiel | 339/217 S |
| 3,808,588 | 4/1974 | McTregor | 339/275 B |

*Primary Examiner*—Joseph H. McGlynn
*Attorney, Agent, or Firm*—R. P. Miller

[57] ABSTRACT

A plug-in terminal for connecting a stranded insulated conductor with a conductive path on a circuit board includes a barrel of ductile metal for receiving a stripped end of the conductor. The barrel has a first section at a first end thereof for gripping the insulation on the conductor adjacent the stripped end, a second openended section at a second and opposite end thereof for surrounding and loosely gripping the strands at the extremity of the stripped end, and a third section, between the first and the second sections, for surrounding and tightly gripping the strands. After being crimped onto the conductor, the terminal is extended through a hole formed through the circuit board and the conductive path thereon. Locating and locking tabs extend from the terminal to position the terminal within the hole with the second section projecting beyond the conductive path, and to then secure the terminal within the hole. Solder applied over the second section and the conductive path enters, as a result of the strands being loosely gripped within the second section, within the open end of the second section and around the strands to effect a secure electrical and mechanical connection between the terminal, the strands, and the path.

8 Claims, 11 Drawing Figures

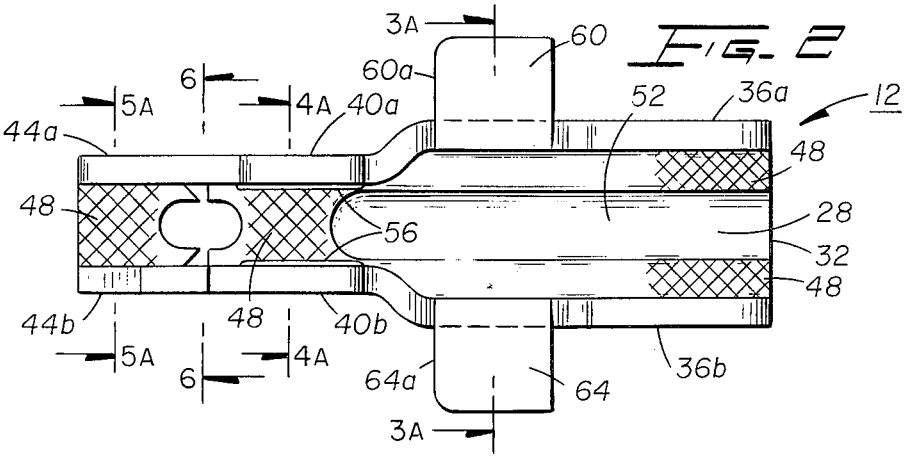
FIG. 2
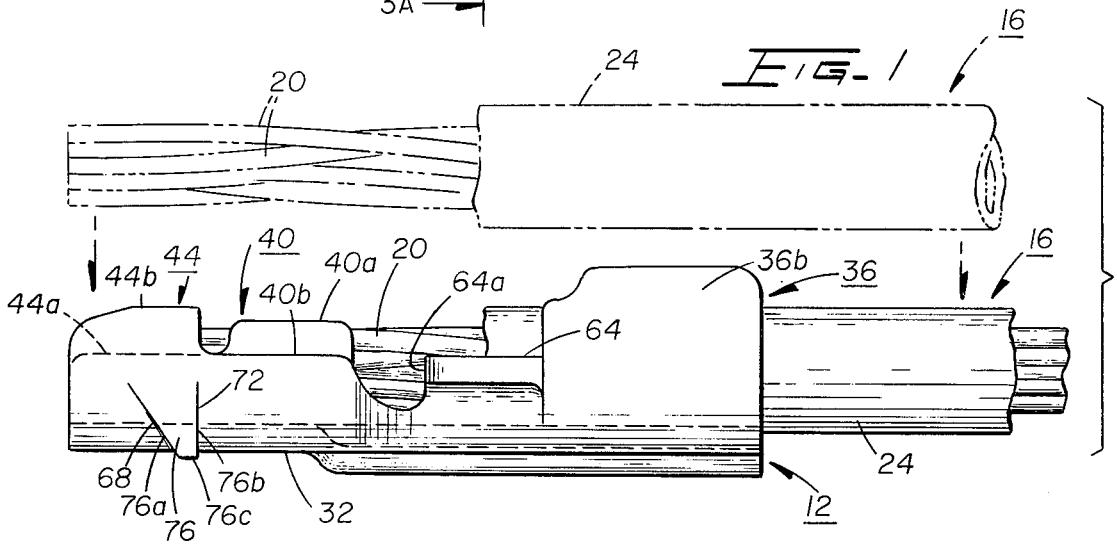
FIG. 1
FIG. 3A
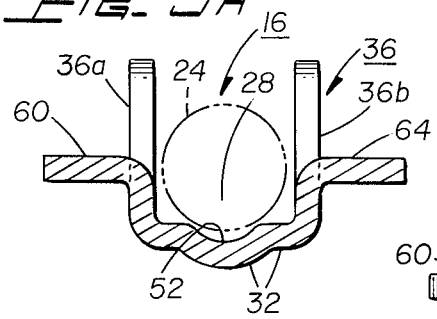
FIG. 4A
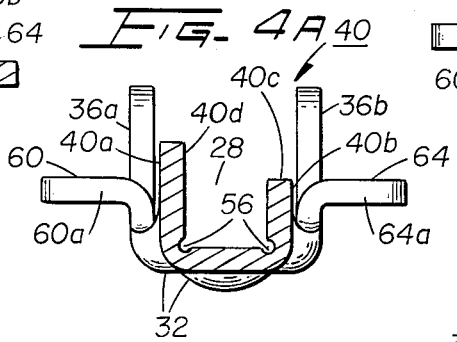
FIG. 5A
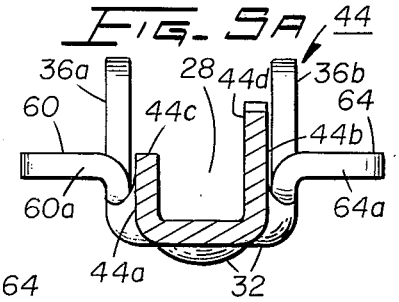
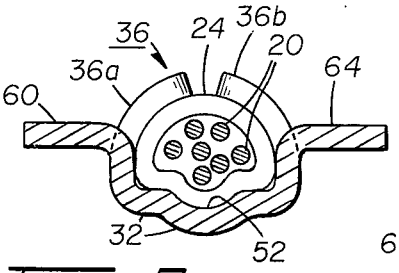
FIG. 3B
FIG. 4B
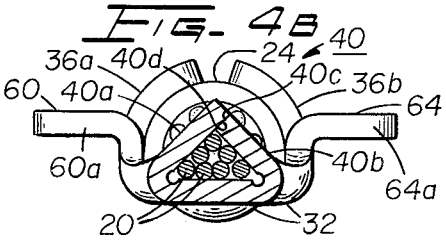
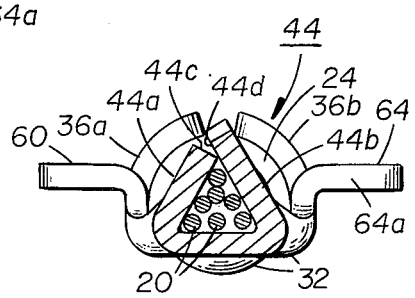
FIG. 5B

PLUG-IN TERMINAL

BACKGROUND OF THE INVENTION

1. Field of the Invention

The present invention relates to plug-in terminals, and in particular to a terminal for gripping and positioning a stripped end of a stranded insulated conductor in proximity with a conductive path on a circuit board for being soldered thereto, wherein the extremity of the stripped end is loosely gripped by a section of the terminal to allow passage of the solder within the section and around the strands.

2. Description of the Prior Art

In the manufacture of electronic equipment, connections between solderable conductive paths on a circuit board and stranded insulated conductors are often accomplished through the use of wire connectors or terminals. A stripped end of the conductor is crimped within an elongated, plug-in terminal, with a first end of the terminal tightly gripping the strands along the stripped end and with a second and opposite end of the terminal gripping the insulation adjacent the stripped end. The terminal is then extended through a hole in the circuit board which passes through, and is surrounded by, the conductive path, to position the first end of the terminal slightly beyond the path. A glob of molten solder is then deposited over the first end of the terminal and the conductive path to effect an electrical connection, through the body of the terminal and the solder, between the conductor and the path, and to secure the terminal to the path and within the hole in the circuit board.

With conventional plug-in terminals, the strands are either completely encased within or tightly gripped by the terminal at the extremity of the stripped end, which precludes the deposited solder from readily entering within the terminal and around and between the strands therewithin. Therefore, the structural and electrical bond established by the solder exists only between the conductive path, the solder, and the outside body of the terminal at the first end thereof.

The conductive path on a circuit board is immobile and, accordingly, a connection made thereto with solder generally remains secure. The terminal, however, is subject to forces and strains exerted thereon by movement of the conductor as well as by flexing of the circuit board. These forces and strains may, and often do, destroy the electrical and metallurgical bond between the terminal and the solder which, of course, destroys the electrical connection between the conductor and the conductive path on the circuit board. Ordinarily, the application of solder over the terminal and the conductive path is accomplished by passing the circuit board over a solder wave, which is an economical operation. Repair of one or more destroyed connections, however, requires troubleshooting by a technician to first locate the bad connections, and then manual resoldering thereof, both of which are time consuming operations, and therefore expensive.

Another problem encountered with conventional plugin terminals is in extending the terminals through the circuit board to project a predetermined distance beyond the conductive path, and in preventing withdrawal of the terminals from the circuit board prior to the soldering thereof. Projection of the terminals beyond the path by less than a predetermined distance may result in a weak and inadequate solder connection between the terminals and the path, or possibly in no connection at all. Projection of the terminals beyond the path by more than the predetermined distance may require manual trimming or machining of the ends of the terminals to prevent accidental shorting between circuit boards which are in a closely spaced, side-by-side relationship. And, of course, withdrawal of terminals from the circuit board prior to soldering thereof requires operator reinsertion.

SUMMARY OF THE INVENTION

In accordance with the present invention, a connector of a ductile metal for terminating a conductor at an end thereof includes an elongated base member, and a first pair of side walls projecting up from opposite sides of the base at a first point therealong, for receiving therebetween the extremity of the end of the conductor, and deformable around the conductor thereat to loosely grip the conductor. Also included is a second pair of side walls projecting up from opposite sides of the base at a second point therealong, for receiving therebetween the conductor in proximity with the extremity of the end thereof, and deformable around the conductor thereat to tightly grip the conductor.

More particularly, the terminal includes an elongated base for having the wire overlaid on a surface thereof along its length with the insulator adjacent the stripped end overlying a first end of the base, with the extremity of the stripped end overlying a second and opposite end of the base, and with the conductor between the extremity of the stripped end and the insulation overlying a central portion of the base. A first pair of first and second side walls extend from the surface of the base at the first end thereof, and are bendable around the insulation on a wire overlying the first end of the base.

A second pair of first and second side walls extend from the surface of the base at the center portion of the base on opposite sides thereof, with the second side wall extending further from the base than the first side wall, and are bendable around a wire overlying the base thereat into an opposing relationship to abut the end of the first side wall against the edge face of the second side wall to define with the base a triangular shaped configuration, the height of the side walls being chosen to tightly grip the wire therewith. A third pair of first and second side walls extend from the surface of the base at the second end of the base on opposite sides thereof, and are bendable around the extremity of a wire overlying the base thereat into an opposing relationship to abut the end of the second side wall against the edge face of the first side wall and to define with the base an open-ended triangular shaped configuration, the first side wall of the pair extending further from the base than the second side wall thereof, and the first and second side walls of the third pair extending further from the base than the second and first side walls, respectively, of the second pair, to grip the wire with the third pair of side walls less tightly than with the second pair of side walls.

In another aspect of the invention, a terminal and circuit board assembly includes a circuit board having a solderable circuit path on at least a first surface thereof and a hole extending from the first to a second and opposite surface thereof, and through the circuit path. Also included is a terminal of a barrel of ductile metal, having a sufficient length to extend within and through the circuit board hole, for receiving an insulated stranded conductor having the insulation stripped from an end thereof. The barrel has a first section for gripping therewithin the insulation adjacent the stripped end of the stranded conductor, a second section for loosely gripping therewithin the strands in the vicinity of the extremity of the stripped end, opened at the extreme stripped end to expose the ends of the strands, and a third section, between the first and the second sections, for tightly gripping therewithin the strands at the stripped end, and is extended through the hole in the circuit board to project the second section beyond the circuit path. A glob of solder secured to the circuit path and the second section of the terminal extends through the opening of the second section into the loosely gripped strands within the second section.

Further included in the assembly are members projecting from the second section for engaging the circuit path to hold the terminal against withdrawal movement toward the second surface of the circuit board hole, and a pair of stop arms, extending outwardly from opposite sides of the barrel at a point intermediate the first and the third sections, each having a side facing the members and spaced therefrom by a distance which is at least equal to the combined thickness of the circuit board and the conductive path, for engaging the second surface of the circuit board as the terminal is extended through the hole therein to preclude pushing the terminal completely through the hole, the members and the arms together operating to secure and to position the terminal within the circuit board hole.

BRIEF DESCRIPTION OF THE DRAWINGS

FIG. 1 is a side elevation view of the plug-in terminal of the invention, and illustrates the configuration of the terminal prior to crimping the terminal around a conductor therewithin;

FIG. 2 is a top plan view of the terminal shown in FIG. 1;

FIG. 3*a* is a view taken along the lines 3*a*—3*a* of FIG. 2, and illustrates a ferrule, for gripping insulation on a stranded conductor, prior to crimping;

FIG. 3*b* shows the ferrule of FIG. 3*a* crimped around the insulation on a conductor;

FIG. 4*a* is a view taken along the lines 4*a*—4*a* of FIG. 2, and illustrates a ferrule, for tightly gripping the strands on the conductor, prior to crimping;

FIG. 4*b* shows the ferrule of FIG. 4*a* crimped around the strands of the conductor;

FIG. 5*a* is a view taken along the lines 5*a*—5*a* of FIG. 2, and illustrates a ferrule, for loosely gripping the strands of the conductor, prior to crimping;

FIG. 5*b* shows the ferrule of FIG. 5*a* crimped around the strands of the conductor;

DETAILED DESCRIPTION

Figure 6:
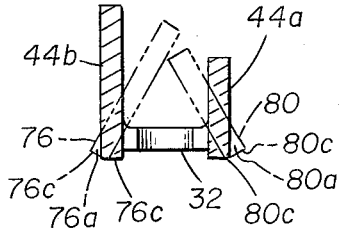
FIG. 6 is a view taken along the lines 6—6 of FIG. 2, and illustrates a pair of cleats extending from the ferrule of FIG. 5*a;*

The drawings illustrate a barrel-shaped plug-in terminal, or wire connector 12, for being crimped onto the skinned end of an insulated stranded conductor, or wire 16. As will be seen, the barrel terminal 12 is particularly adapted for facilitating an electrical connection between the conductor and a conductive circuit path on a surface of a circuit board.

Referring to FIG. 1, there is shown a section of the wire 16 comprising an inner bundle of conductive wire, or strands 20, within an insulated sheath 24. One end of the wire 16 is stripped of the insulation 24, and is adapted to be seated within a channel 28 formed through the terminal 12. The other end of the conductor 16 (not shown) may be terminated as desired, such as to a second terminal 12 or to any other type of terminal.

With reference to both FIGS. 1 and 2, the terminal 12 is shaped in a progressive punch and die from a blank strip of brass or other ductile metal having good deformation properties as well as good electrical conductive properties. The barrel terminal is actually in the form of a U-shaped clip having an elongated base 32 and three upwardly projecting wall sections 36, 40 and 44 formed therealong and on opposite sides thereof. The wall sections 36, 40 and 44 each form, with the base 22, essentially coaxial, or longitudinally aligned, U-shaped ferrules for grasping the stripped end of the wire 16, and define the channel 28 therebetween and along the base 32. With particular reference to FIG. 1, when the terminal 12 is to be crimped onto the wire 16 the stripped end of the wire is positioned within the channel 28 and along the length of the base 32 with the insulation 24 adjacent the stripped end within the section 36, with the strands 20 adjacent the insulation 24 within the section 40, and with the strands at the extremity of the stripped end within the section 44. The inner surfaces of the wall sections 36, 40 and 44 are provided with knurls 48 to assist in the mechanical gripping of the strands 20 and insulation 24 when the terminal 12 is crimped onto the conductor 16.

As shown in FIG. 3*a*, the section 36 comprises a pair of deformable side walls 36*a* and 36*b*, between which the channel 28 extends, which project upwardly from opposite sides of the base 32 and which, with the base, form the U-shaped ferrule for gripping the insulation 24 on the conductor 16 adjacent the stripped end thereof. The base 32 has a circular channel 52 formed along its length in the vicinity of the side walls 36*a* and 36*b* to minimize crushing of the insulation 24 on the conductor 16 when, as shown in FIG. 3*b*, the side walls 36*a* and 36*b* are press formed inwardly, or deformed, toward each other by a suitable tool to grip the insulation 24.

The section 40, as shown in FIG. 4*a*, comprises a pair of side walls 40*a* and 40*b*, between which the channel 28 also extends, which project upwardly from opposite sides of the base 32 and which together, with the base, form the U-shaped ferrule for gripping the strands 20 at the stripped end of the conductor 16 just beyond the insulation 24 within the section 36. The side wall 40*a* has a greater height than the side wall 40*b* and, with the strands 20 of the conductor 16 positioned between the side walls 40*a* and 40*b*, the side walls are deformable, or press formable inwardly as shown in FIG. 4*b*, into an opposed relationship to abut, or engage, an end 40*c* of the side wall 40*b* against an edge face 40*d* of the side wall 40*a*. To facilitate the inward deformation of the side walls 40*a* and 40*b*, score lines 56 are formed on the inner facing sides of the side walls at the point where the side walls join the base 32. In their opposed abutting relationship, the side walls 40*a* and 40*b*, with the base 32, form a triangular shaped configuration around the strands 20, and the height of the side walls 40*a* and 40*b* is chosen so that, when the side walls are in the abutting relationship, the strands 20 are tightly, or firmly, gripped thereby.

As shown in FIG. 5*a*, the section 44 comprises a pair of side walls 44*a* and 44*b*, between which the channel 28 similarly extends, which project upwardly from opposite sides of the base 32 and which together, with the base, form the U-shaped ferrule for gripping the strands 20 at the extremity of the stripped end of the conductor 16. The wall 44*b* has a greater height than the wall 44*a* and, as shown in FIG. 5*b*, with the strands 20 at the extremity of the conductor 16 positioned within the section 44, the side walls are deformable, or press formable inwardly, into an opposed relationship to abut, or engage, an end 44*c* of the wall 44*a* against an edge face 44*d* of the side wall 44*b* to form, with the base 32, an open-ended triangular shaped configuration for gripping therewithin the strands 20. The side walls 44*a* and 44*b* of the section 44 are each higher than the corresponding side walls 40*b* and 40*a* of the section 40. As a result, upon being deformed into the abutting relationship around the strands 20, the side walls 44*a* and 44*b* of the section 44 grip, or crimp, the strands 20 less firmly, or more loosely, than the walls 40*a* and 40*b* grip the strands, to leave the interstices between the individual strands open within the section 44 to receive a capillary flow of solder, through an open end 46 of the section 44, as will later be described.

The height of the side walls of the sections 40 and 44, along with the width of the base 32, are chosen, for any given diameter or gauge of a bundle of strands 20, to grip the strands with a selected degree of firmness upon being crimped therearound in the described configuration. It should be noted, in the preferred embodiment of the invention, that opposite side walls 40*b* and 44*a* are abutted against the edge faces of their opposing side walls 40*a* and 44*b* to improve the crimp strength exerted by the deformed wall sections 40 and 44 under conditions wherein the terminal 12, after being crimped to the end of the conductor 16, is subjected to twisting forces or bumping engagement. Also, prior to crimping, the three side walls 36*a*, 40*a* and 44*a* projecting upwardly from one side of the base are approximately longitudinally aligned, and the three side walls 36*b*, 40*b* and 44*b* projecting upwardly from the opposite side of the base are also approximately longitudinally aligned.

Interposed between the sections 36 and 40 is a pair of lateral ears, or stop arms 60 and 64, which extend from, and project beyond, opposite sides of the base 32 in a plane which is essentially parallel to the plane of the base. The stop arms 60 and 64 each have a leading edge 60*a* and 64*a*, respectively, which extends essentially perpendicular to the channel 28, and therefore to the length of the base 32, and which, as will be seen, limits the distance that the terminal 12 may be inserted within a hole in a printed circuit board.

The lower portion of each of the side walls 44*a* and 44*b* of the section 44 is slit along a pair of lines 68 and a pair of lines 72 to form a pair of substantially right triangular tabs 76 and 80 with a portion of the side walls, as seen in FIGS. 1 and 6 (FIG. 1 showing only the slits formed along the lines 68 and 72, of the pairs of lines, in the side wall 44*b*). The lines 68 and 72 together form two sides of each triangular tab 76 and 80, a third side of each tab being defined by a line between the ends of the lines 68 and 72 and along an integral juncture of each tab with its associated side wall 44*a* or 44*b*. Each line 68 slopes from its juncture with its associated side wall toward the section 40 to form a beveled edge, or cam edge 76*a* and 80*a*, on the tabs 76 and 80, respectively, and each line 72 is essentially perpendicular to the length of the base 32 to form rear edges 76*b* and 80*b* on the tabs 76 and 80, respectively. A short slit between the lower ends of the pairs of lines defines base portions 76*c* and 80*c* for the tabs 76 and 80, respectively, and frees the lower end of the tabs 76 and 80 from the side walls 44*a* and 44*b*.

Figure 7:
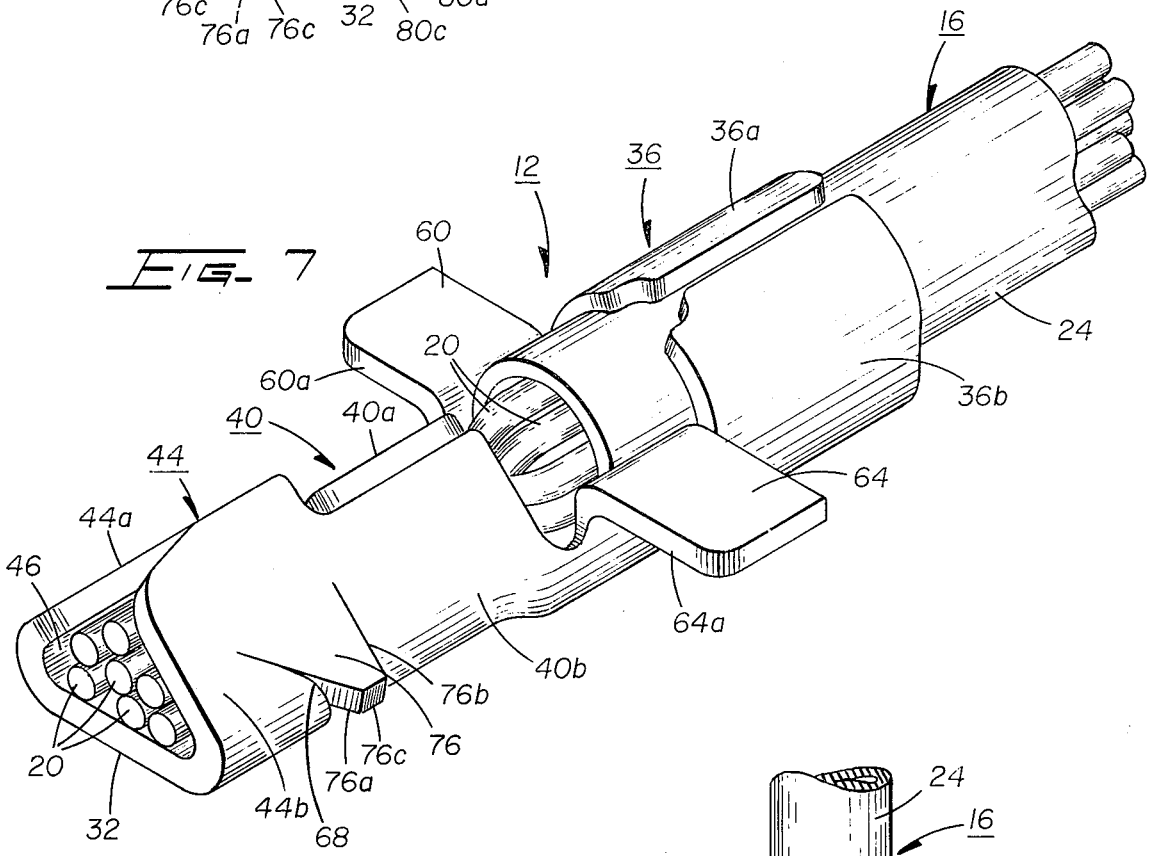
FIG. 7 is an isometric view of the terminal as crimped around a stranded insulated conductor.

When the blank strip of ductile metal is initially formed to make the barrel terminal 12, the base portions 76*c* and 80*c* of the tabs 76 and 80 are moved with the side walls 44*a* and 44*b* to extend slightly from the base 32, as shown in solid lines in FIG. 6. Then, upon deforming or crimping inwardly of the side walls 44*a* and 44*b* about the strands 20, the base portions 76*c* and 80*c* of the tabs 76 and 80 are moved further away from the sides of the base 32, as shown in phantom lines in FIG. 6. As will be seen, the tabs form locking cleats to secure a terminal 12 from withdrawal after insertion within a hole in a printed wiring board. FIG. 7 illustrates the terminal 12 crimped onto the stripped end of the conductor 16.

Figure 8:
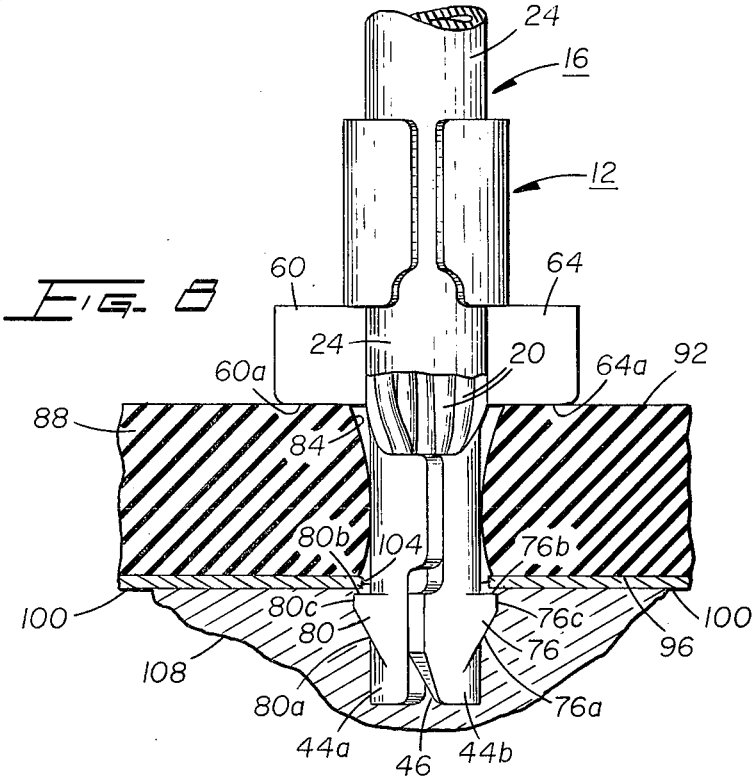
FIG. 8 shows the terminal crimped around a conductor and extended through a hole in a circuit board.

Referring to FIG. 8, in use of the terminal 12 to connect the conductor 16 with a conductive path on a printed circuit board, and to fabricate a plug-in terminal and circuit board assembly, the terminal is crimped onto the stripped end of the conductor 16 and extended through a hole 84 in a printed wiring board 88 in a direction extending from a first surface 92 of the board to a second and opposite surface 96 thereof. A conductive path 100 of a solderable material is formed on the second surface 96 around the hole 84, and defines an exit hole 104 coaxial with the hole 84 and around the periphery thereof. The diameter of the hole 84 and the exit hole 104 is sufficient to allow extension of the main body portion of the terminal 12 therewithin, but is less than both the distance between the base portions 76*c* and 80*c* of the tabs 76 and 80, and the distance between the ends of the stop arms 60 and 64.

When the terminal 12 is extended through the hole 84 in the circuit board 88, the edges 76*a* and 80*a* of the tabs 76 and 80 act as a cam against the edges of the hole 84 to resiliently move, or urge, the tabs 76 and 80 toward their associated side walls 44*a* and 44*b* to allow the terminal to enter and to be easily extended within the hole. Then, when the rear edges 76*b* and 80*b* of the tabs 76 and 80 pass beyond the exit hole 104 in the conductive path 100, the tabs move resiliently outwardly, or snap outwardly, beyond the diameter of the exit hole 104 and over the surface of the conductive path 100 to preclude withdrawal of the terminal 12 from the hole by the action of the rear edges 76*b* and 80*b* of the tabs against the solder path 100. Insertion of the terminal 12 is continued until the leading edges 60*a* and 64*a* of the stop arms 60 and 64 engage the surface 92 to stop the movement of the terminal through the holes 84 and 104. It is understood, of course, that the spacing between the rear edges 76*b* and 80*b* of the tabs 76 and 80, and the forward edges 60*a* and 64*a* of the stop arms 60 and 64, is greater than the axial distance through the holes 84 and 104, and preferably the spacing is only slightly greater than the axial distance, with the stop arms 60 and 64 positioned to limit the distance which the terminal 12 may be extended through the holes 84 and 104 to position the section 44 to extend slightly beyond the conductive path 100.

It may thus be appreciated that upon extension of the terminal 12 through the holes 84 and 104 in the circuit board 88, the leading edges of the stop arms 60 and 64 engage the surface 92 to prevent the terminal from passing completely through the holes, the rear edges of the tabs 76 and 80 operate as locking cleats to engage the surface of the conductive path 104 to prevent withdrawal of the terminal 12 from the holes, and the terminal 12 is firmly and positively locked within the circuit board between the leading edges of the stop arms 60 and 64 and the rear edges of the tabs 76 and 80.

With the terminal 12 extended through and positively locked within the circuit board 88, the circuit board is passed through a solder wave (not shown) with the surface 96 engaging the solder wave. The impinging solder adheres as a glob of solder 108 over and to the section 44 of the terminal and the conductive path 100, enters the open end 46 of the section 44, and is drawn by capillary action into the interstices between the loosely held strands 20 within the section 44. This forms a secure electrical and metallurgical connection between the terminal, the circuit path, and the strands 20 of the conductor 16. During the soldering operation the stop arms 60 and 64 act as radiators, or fins, to dissipate a portion of the heat conducted through the body of the terminal 12 to decrease the heat conducted to the section 36 to eliminate, or to minimize, charring of the insulation 24 gripped therewithin.

It is to be appreciated, as a result of the strands 20 at the extremity of the stripped end of the conductor 16 being loosely gripped, or crimped, within the open-ended section 44 of the terminal 12, that during soldering the solder readily enters the section 44 and contacts the exposed ends of the loosely gripped strands 20 to flow, by capillary action into the interstices between the individual strands to effectively and securely connect the strands to the terminal and to the circuit path 100, which capillary flow would be inhibited if the strands were tightly gripped or if the section 44 had a closed end. Thus it is seen that the conductor 16 and the terminal 12 are securely connected both with the conductive path 100, and with each other, by the tight gripping action of the section 43 on the strands 20, as well as by the solder between and around the strands 20 within and to the section 44.

The end of the conductor 16, away from the terminal 12 connected with the conductive path 100, may be connected to a point in an external circuit by any means, such as with a second terminal 12, to establish a path for the passage of signals or voltages therebetween. Or a connection may be established between two conductive paths 100 on the same circuit board 88 with a jumper strap comprising a conductor 16 having terminals 12 crimped to both ends thereof.

While one embodiment of the invention has been described in detail, it is understood that various other modifications and embodiments may be devised by one skilled in the art without departing from the spirit and scope of the invention.

I claim:

1. An electrical connector, which comprises:

an elongated ferrule base constructed of electrically conductive, ductile material;

a pair of first side walls projecting in the same direction from opposite sides of said ferrule base along the length thereof, said first side walls being of different heights and being of sufficient heights to be deformed toward each other to abut the end of the shorter side wall against the edge face of the longer side wall to define with the ferrule base a triangular configuration, and a pair of second side walls projecting in said same direction from opposite sides of said ferrule base along the length thereof, said second side walls being of different heights and projecting further from said base than said first side walls, and being of sufficient heights to be deformed toward each other to abut the end of the shorter second side wall against the edge face of the longer second side wall to define with the ferrule base a triangular configuration having a cross-sectional area which is greater than that of the triangular configuration defined by the deformed first side walls.

2. An electrical connector, as defined in claim 1, wherein the shorter walls of said pairs of first and second walls project from opposite sides of said ferrule base.

3. An electrical connector as defined in claim 1, which includes:

a pair of third side walls projecting in said same direction from opposite sides of said ferrule base, said third walls being of equal heights.

4. An electrical connector for an insulated electrical conductor having a stripped end section, which comprises:

an elongated ferrule base constructed of electrically conductive, deformable material for receiving in overlying relation the stripped end section and an adjacent end portion of said insulated conductor;

a pair of first walls projecting from opposite edges of said ferrule base, said first walls being deformed toward each other and being of sufficient heights to substantially encircle and grip the insulation adjacent the stripped end of the conductor;

a pair of second walls projecting from opposite edges of said ferrule base, said second walls being deformed toward each other and being of sufficient heights to abut the end of a second side wall against the inner edge face of the other second wall to define with the ferrule base a triangular configuration for firmly gripping a portion of the stripped end section of the conductor adjacent to the gripped insulation; and a pair of third walls projecting from opposite edges of said ferrule base, said third walls being of heights greater than the heights of the second walls, said third walls also being deformed toward each other to abut the end of a third wall against the inner edge face of the other third wall to define with the ferrule base a triangular configuration of greater cross-sectional area than that defined by the second side walls for encircling and lightly gripping the extremity of the stripped end section of the conductor.

5. A circuit board and terminal plug assembly, wherein the circuit board has a hole extending therethrough and a circuit path on one side thereof which extends to said hole, and the terminal plug comprises:

a connector as defined in claim 4 seated within said hole with said third pair of walls projecting from said circuit path side of said board and beyond said circuit path; and a glob of solder secured to said circuit path and said third walls, and extending into the deformed third side walls and around the lightly gripped end of the conductor to electrically connect the conductor to said circuit path.

6. A circuit board and terminal plug assembly as defined in claim 5, wherein the connector includes:

a pair of laterally extending stop arms engaging a surface of the circuit board for positioning said connector with the deformed third walls projecting beyond said circuit path and said deformed second walls within said hole; and a pair of projecting locking cleats engaging said circuit path for holding said connector against withdrawal from said hole.

7. In an electrical connector of a ductile conductive metal for terminating a stranded insulated wire at an end thereof which has the insulation stripped therefrom:

an elongated base member for having the wire overlaid on a surface thereof along its length with the insulation adjacent the stripped end overlying a first end of the base, with the extremity of the stripped end overlying a second and opposite end of the base, and with the length of wire between the extremity and the insulation overlying a central portion of the base;

a first pair of side walls at the first end of the base projecting up from opposite sides of the base between which a channel is defined extending along the length of the base from the first to the second and opposite end of the base, and deformable around the insulation on a wire overlying the base thereat to surround the insulation within the channel;

a second pair of first and second side walls at the second end of the base projecting up from opposite sides of the base and between which the channel passes, and deformable around the extremity of the stripped end of a wire overlying the base thereat to abut the end of one side wall of the pair against the edge face of the other side wall of the pair to loosely grip the strands within the channel, and with the base to define an open-ended triangular shaped configuration;

a third pair of first and second side walls projecting up from opposite sides of the base at the central portion thereof and between which the channel passes, and deformable around the stripped end of a wire overlying the base thereat to abut the end of one side wall of the pair against the edge face of the other side wall of the pair to tightly grip the strands within the channel, and with the base to define a triangular shaped configuration, wherein the first side wall of each of the second and third pairs of side walls is on the same side of the base, the first side wall of the third pair projects further from the base than the second side wall of that pair, the second side wall of the second pair projects further from the base than both the first side wall of that pair and of the third pair, the first side wall of the second pair projects further from the base than the second side wall of the third pair, the end of the first side wall of the second pair abuts the edge face of the second side wall of that pair, and the end of the second side wall of the third pair abuts the edge face of the first side wall of that pair, and a pair of arms which extend in opposite directions beyond the sides of the base at a point intermediate the first and the third pairs of side walls, each arm having an edge toward the second end of the base which extends essentially perpendicular to the length of the base.

8. In a wire connector of a ductile conductive metal for terminating an insulated wire having the insulation stripped from an end thereof:

an elongated base for having the wire overlaid on a surface thereof along its length with the insulation adjacent the stripped end overlying a first end of the base, with the extremity of the stripped end overlying a second and opposite end of the base, and with the length of wire between the extremity of the stripped end and the insulation overlying a central portion of the base;

a first pair of first and second side walls extending from the surface of the base at the first end of the base on opposite sides thereof, bendable around the insulation on a wire overlying the first end of the base;

a second pair of first and second side walls extending from the surface of the base at the central portion of the base on opposite sides thereof with the second side wall extending further from the base than the first side wall, bendable around a wire overlying the base thereat into an opposing relationship to abut the end of the first side wall against the edge face of the second side wall and to define with the base a triangular shaped configuration, the height of the side walls being chosen to tightly grip the wire therewith, and a third pair of first and second side walls extending from the surface of the base at the second end of the base on opposite sides thereof, bendable around the extremity of a wire overlying the base thereat into an opposing relationship to abut the end of the second side wall against the edge face of the first side wall and to define with the base an open-ended triangular shaped configuration, the first side wall of the pair extending further from the base than the second side wall thereof, and the first and second side walls of the third pair extending further from the base than the second and first side walls, respectively, of the second pair, to grip the wire with the third pair of side walls less tightly than with the second pair of side walls.

* * * * *

UNITED STATES PATENT OFFICE

CERTIFICATE OF CORRECTION

Patent No. 3,953,103 Dated April 27, 1976

Inventor(s) JOSEPH D. MATHIS

It is certified that error appears in the above-identified patent and that said Letters Patent are hereby corrected as shown below:

Front Page of Patent [22] "Filed: January 27, 1974" should read --Filed: January 27, 1975--.

Signed and Sealed this

*Fourth* Day of *October 1977*

[SEAL]

*Attest:*

RUTH C. MASON
*Attesting Officer*

LUTRELLE F. PARKER
*Acting Commissioner of Patents and Trademarks*